US006116685A

United States Patent [19]

White et al.

[11] Patent Number: 6,116,685

[45] Date of Patent: Sep. 12, 2000

[54] UNITARY SLIPCOVER WITH STRAIGHT FRONT SKIRT

[75] Inventors: Cecil A. White, New York, N.Y.; Susan Shaner, Easton, Pa.

[73] Assignee: Sure-Fit, Inc., New York, N.Y.

[21] Appl. No.: 09/206,572

[22] Filed: Dec. 7, 1998

[51] Int. Cl.[7] ..... A47C 27/00

[52] U.S. Cl. ..... 297/218.1; 297/225

[58] Field of Search ..... 297/218.1, 224, 297/225, 229, 228.1, 228.2

[56] References Cited

U.S. PATENT DOCUMENTS

| | | | |
|---|---|---|---|
| Re. 24,279 | 2/1957 | Schutte et al. . | |
| 1,695,244 | 12/1928 | Cohen . | |
| 1,820,104 | 8/1931 | Whaley | 297/224 |
| 1,825,909 | 10/1931 | Levi . | |
| 2,183,828 | 12/1939 | Trubitz . | |
| 2,202,065 | 5/1940 | Peebles | 297/229 |
| 2,367,450 | 1/1945 | Trubitz . | |
| 2,677,211 | 1/1954 | Krasnov et al. . | |
| 2,793,683 | 5/1957 | Trubitt . | |
| 2,797,743 | 7/1957 | Rodtz, Jr. | 297/229 |
| 2,848,039 | 8/1958 | Lenz . | |
| 2,871,924 | 2/1959 | Trubitt . | |
| 2,884,993 | 5/1959 | Schutte . | |
| 3,116,953 | 1/1964 | Sugarman | 297/225 |
| 4,838,610 | 6/1989 | Perrin | 297/225 |
| 5,320,407 | 6/1994 | Tell . | |
| 5,549,355 | 8/1996 | Illulian | 297/224 |
| 5,664,831 | 9/1997 | White et al. | 297/225 |
| 5,690,380 | 11/1997 | Waters | 297/228.11 X |

FOREIGN PATENT DOCUMENTS

| | | | |
|---|---|---|---|
| 516591A | 12/1992 | European Pat. Off. | 297/225 |
| 2 399 223 | 3/1979 | France . | |
| 1 300 582 | 12/1972 | United Kingdom . | |

*Primary Examiner*—Peter M. Cuomo
*Assistant Examiner*—Stephen Vu
*Attorney, Agent, or Firm*—Darby & Darby

[57] ABSTRACT

A unitary slipcover for covering a seating-type piece of furniture having a base, a back, arms, and a cushioned seat portion. The slipcover includes a seat cushion covering portion with a rear edge. A cinching element terminating in first and second ends is secured therebetween to at least a portion of the rear edge of the seat cushion covering portion for reducing the effective peripheral dimension of at least a portion of the rear edge of the seat cushion covering portion. A main body covering portion of the slipcover is folded in a longitudinal direction and each end is sewn to itself to define arm covering portions. One longitudinal side of the main body covering portion of the slipcover is secured to the seat cushion covering portion and the other longitudinal side is preferably secured to a main body skirt covering portion, which conceals at least a portion of the base of the piece of furniture. A separate substantially planar front skirt covering portion is preferably integral to the seat cushion covering portion and extends therefrom over a front crevice defined between the front edge of the seat cushion and the base of the piece of furniture. The cinching element maintains the seat cushion covering portion positioned securely and neatly across the top of the seat cushion while the draped front skirt provides a slipcover draped appearance. Pairs of binding elements may be secured about the corners of the piece of furniture to further ensure that the slipcover remains properly positioned and to enhance the aesthetic appearance.

47 Claims, 4 Drawing Sheets

UNITARY SLIPCOVER WITH STRAIGHT FRONT SKIRT

FIELD OF THE INVENTION

The present invention relates to a slipcover for a piece of seating-type furniture, such as a chair, loveseat or sofa, and in particular to a unitary slipcover held securely in place along at least a portion of the rear edge of the seat cushions, yet having a slipcover appearance across the front edge of the piece of furniture.

BACKGROUND OF THE INVENTION

Slipcovers are widely used by consumers as an inexpensive alternative to re-upholstering a piece of seating-type furniture. Originally, slipcovers were custom tailored by a professional having the proper tools and training to precisely fit a particular piece of furniture. Custom tailored slipcovers, however, are typically as expensive as the cost of re-upholstering the piece of furniture itself.

Prefabricated slipcovers are currently available as a less expensive alternative to custom tailored slipcovers. These slipcovers are relatively simple in construction and may be easily applied by the consumer to the piece of furniture without requiring any special skills or training.

A unitary prefabricated slipcover is described in U.S. Pat. No. 5,664,831. The slipcover is divided into three sections, a main body portion, a seat cushion covering portion, and a skirt. An elastic band is attached about the perimeter of the seat cushion covering portion for cinching it about the seat cushion, and in particular underneath the front edge of seat cushion. Another elastic band is secured along the seam where the main body portion and skirt are attached to one another. The slipcover disclosed in the patent provides a "semi-fitted" upholstered appearance since the seat cushion covering portion is securely held in a crevice beneath the lower front edge of the seat cushion and the base of the piece of furniture even when sat on.

This patented slipcover construction is disadvantageous, in that it maintains the proper positioning of the seat cushion covering portion while sacrificing the slipcover appearance. A draped, less-fitted slipcover appearance for furniture, however, is preferred by some interior designers and consumers alike to that of the "semi-fitted" appearance. Presently, those who prefer the draped "slipcover" appearance, had to sacrifice structure at all costs to the point at which the slipcover becomes disheveled when sat upon. It is therefore desirable to provide a one-piece slipcover which is capable of maintaining the proper position of the seat cushion covering the seat cushions of the piece of furniture so that the material does not bunch-up when the piece of furniture is sat upon, yet provides a slipcover appearance.

SUMMARY OF THE INVENTION

It is an object of the present invention to provide a unitary slipcover having only a minimal number of pieces and seams.

It is a further object of the invention to provide a slipcover which will provide an aesthetically appealing slipcover suitable for a variety of shaped items of seating-type furniture that can be readily positioned on the piece of furniture.

Another object of the invention is to provide a slipcover that is securely held along at least a portion of the rear edge of the seat cushion of the seating-type piece of furniture to substantially maintain its proper position throughout normal use, yet having a slipcover appearance along the front edge of the seat cushion.

The slipcover in accordance with the present invention is generally of a one-piece construction, and preferably has a minimal number of seams and parts. In a preferred embodiment, the slipcover in accordance with the present invention includes a seat cushion covering portion, a main body covering portion, a main body skirt covering portion, and a front skirt covering portion. One or more cinching elements are secured to at least a portion of the rear edge of the seat cushion covering portion, to reduce the effective peripheral dimension of at least a portion of the rear edge of the seat cushion covering portion. In a preferred embodiment of the invention, the cinching element is in the form of an elastic band which is in a stretched condition while it is secured to at least a portion of the rear edge of the seat cushion covering portion. In this way, when the tension is released from the elastic band, the effective peripheral dimension of at least a portion of the rear edge of the seat cushion covering portion is reduced to form a pouch that cinches at least a portion of the rear edge of the seat cushioned region of the piece of furniture.

The main body skirt covering portion is secured to the main body covering portion and extends downward therefrom to cover at least a portion of the base of the piece of furniture. The front skirt covering portion is preferably substantially planar, uncinched, and integral with the seat cushion covering portion thereby defining a transition area therebetween. When the slipcover is applied to the piece of furniture, the front skirt covering portion and seat cushion covering portion proximate the transition area extends over a front crevice defined between the front edge of the seat cushion and the base of the piece of furniture thereby providing a draped slipcover appearance.

In a further preferred embodiment, pairs of binding elements, such as cords, rope, ribbon, or straps are provide proximate the front and/or rear corners of the piece of furniture to further maintain the slipcover securely and neatly on the piece of furniture.

BRIEF DESCRIPTION OF THE DRAWINGS

In the drawings, wherein like reference numerals delineate similar elements throughout the several views.

DETAILED DESCRIPTION OF THE INVENTION

For ease of explanation, terms such as front, rear, upwards, downwards, horizontal, vertical, etc. are used with reference to the drawings. These terms are not intended to apply to the actual orientation of the elements during use.

Figure 1:
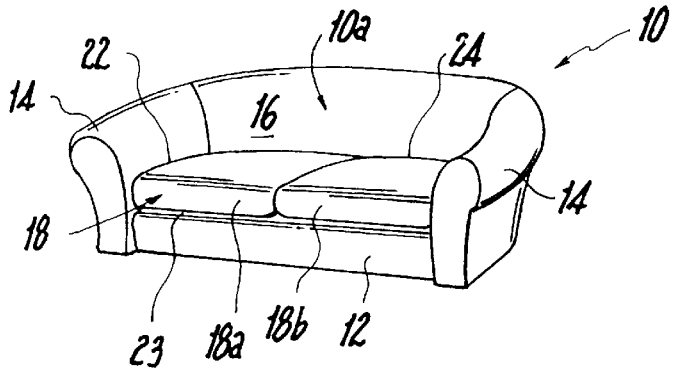
FIG. 1 is a perspective view of a front side of an example sofa as the piece of seating-type furniture.
Figure 2:
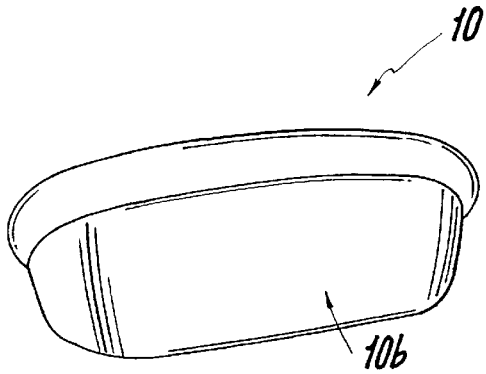
FIG. 2 is a rear view of the sofa of FIG. 1.

The slipcover in accordance with the present invention is applied to a seating-type piece of furniture having a base, a back, and at least one seat cushion, such as a chair, a loveseat, a sofa, or a sofabed. By way of example, the slipcover is shown and described as covering a sofa, but is not intended to limit the invention in any way. FIGS. 1 and 2 show the front 10*a* and back 10*b*, respectively, of a sofa 10 including a base 12, which is typically sufficiently rigid to support the furniture body and persons or things which may be placed on it. The base 12 may be any desired shape and may itself have one or more supplemental legs (not shown) projecting downward therefrom towards the floor.

In the example shown in FIGS. 1 and 2 the sofa 10 includes two arms 14 disposed proximate the lateral ends of the base 12 that project upward therefrom away from the floor. A back 16 extends along a longitudinal side of the base 12 between the two arms 14. The contour and overall shape of the back 16 shown in the Figures is by way of example only, and is not intended to limit the scope of the invention.

A cushioned region 18 extends substantially horizontally across the base 12, to provide a soft surface on which to sit. In the embodiment shown in FIGS. 1 and 2 the cushioned region 18 includes two separate seat cushions 18*a*, 18*b*. It should be noted, however, that the slipcover in accordance with the present invention is suitable for a seating piece of furniture having any number of one or more seat cushions. The cushioned region 18, that is, the individual cushions 18*a*, 18*b*, are preferably at least partially separable from the seat base 12, so that crevices 23, 22, 24 are defined between the cushioned region 18 and the base 12, arms 14, and back 16, respectively, of the sofa 10.

Figure 3:
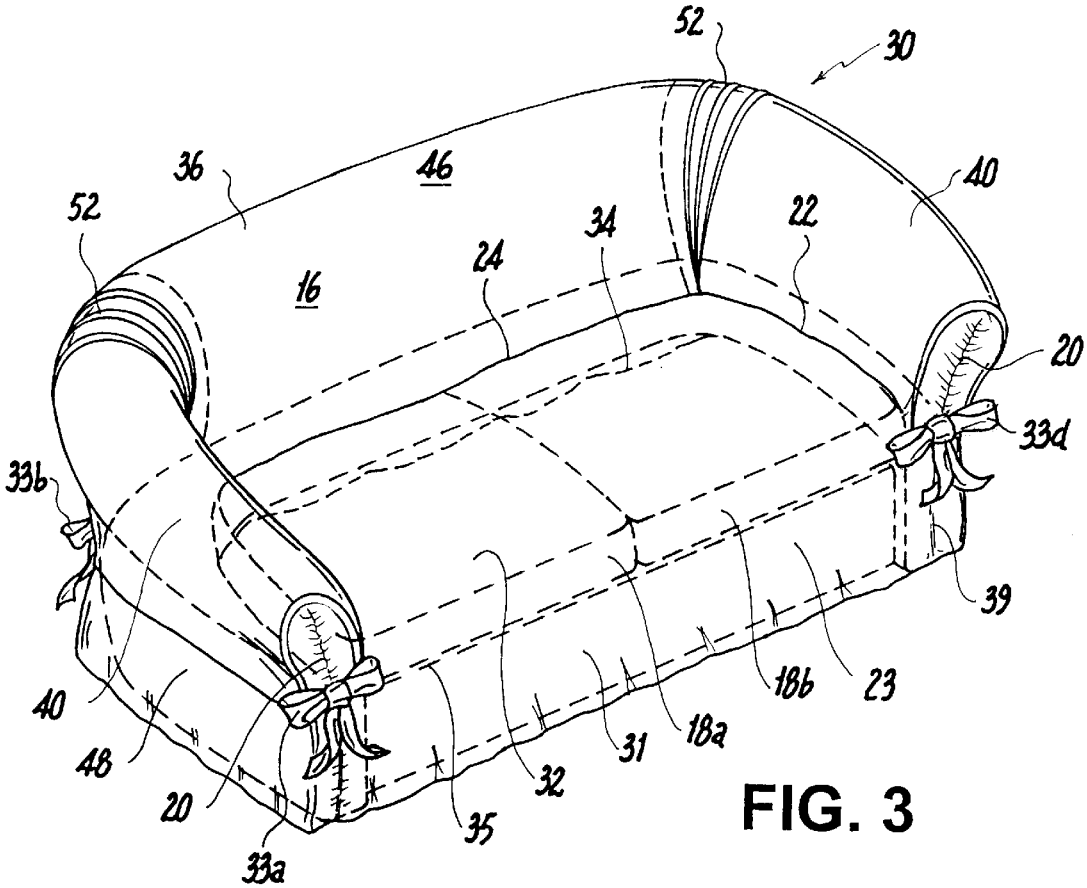
FIG. 3 is a birds-eye perspective view of the front side of the sofa of FIG. 1 having a slipcover according to the present invention positioned thereon.
Figure 4:
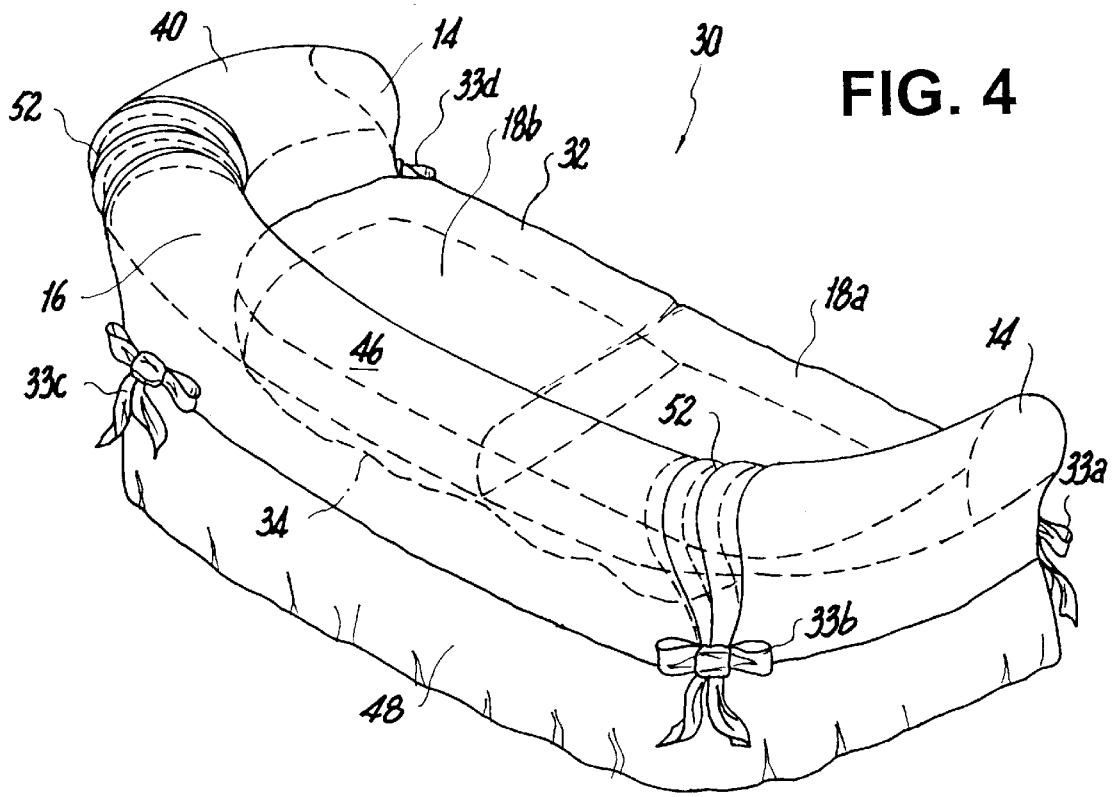
FIG. 4 is a birds-eye perspective view of the back side of the sofa of FIG. 2 having a slipcover according to the present invention positioned thereon.
Figure 5:
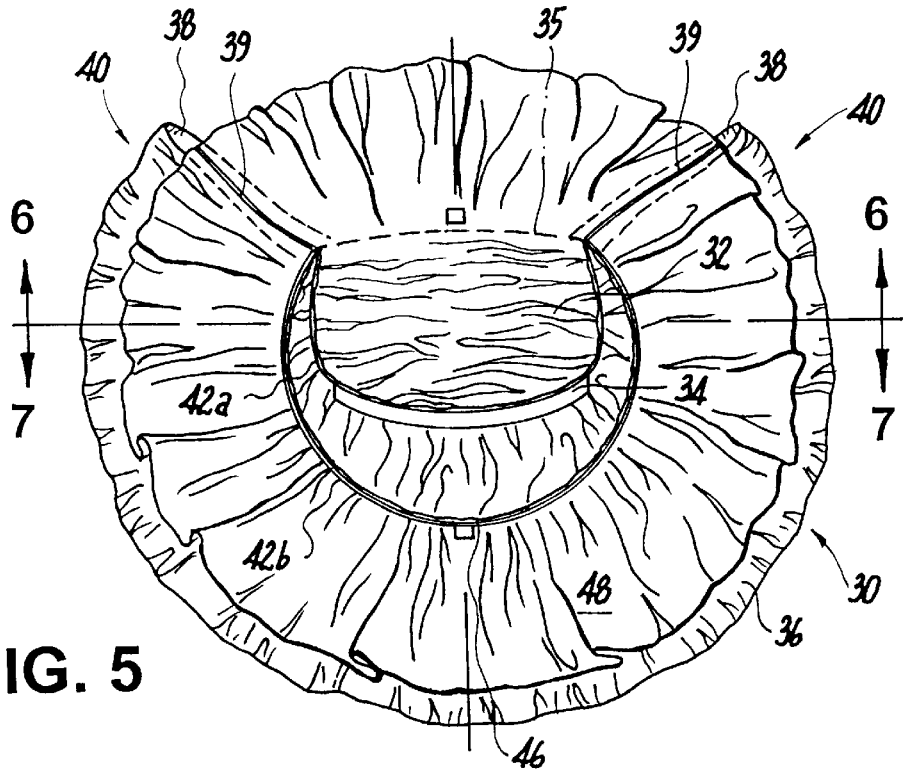
FIG. 5 is a plan view of a slipcover according to the present invention as it appears in a flattened condition prior to being positioned on a piece of furniture.
Figure 6:
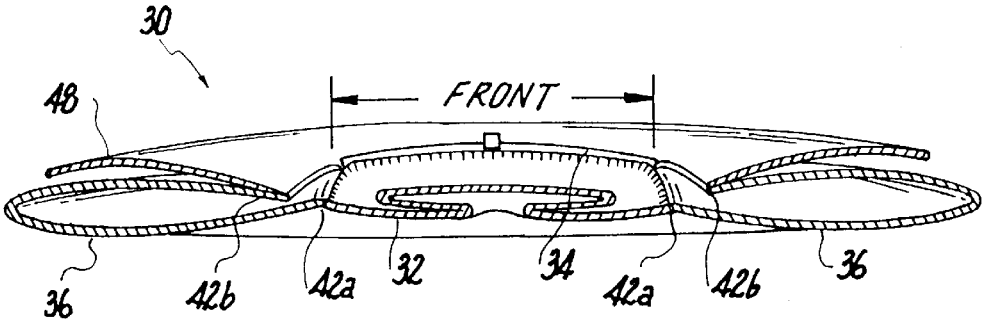
FIG. 6 is a cross-sectional view of a slipcover according to the present invention as shown along lines 6—6 of FIG. 5.
Figure 7:
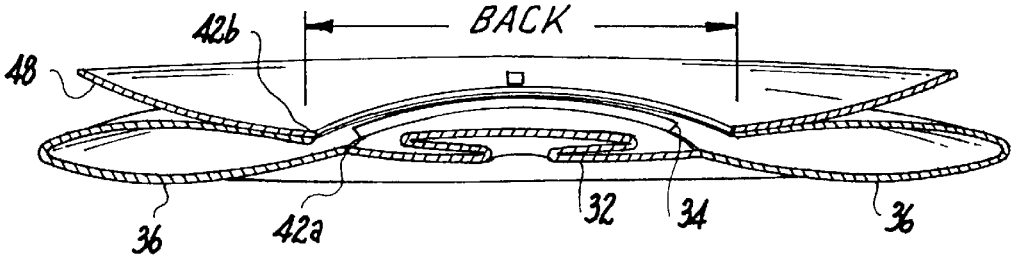
FIG. 7 is a cross-sectional view of a slipcover according to the present invention as shown along the line 7—7 of FIG. 5.
Figure 8:
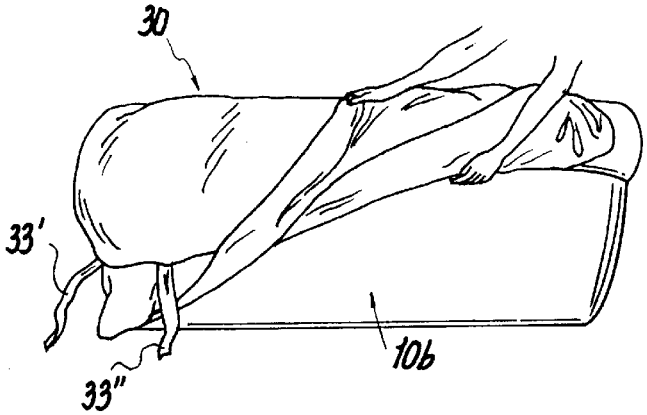
FIG. 8 is a perspective view of a rear side of the sofa of FIG. 2 as a slipcover according to the present invention is being positioned thereon.
Figure 9:
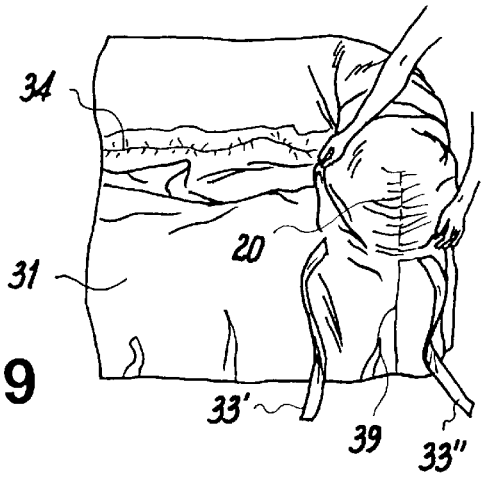
FIG. 9 is a partial perspective view of one arm of the sofa of FIG. 1 as a slipcover according to the present invention is being positioned thereon.

FIGS. 3–7 show the slipcover 30 in accordance with the present invention. In particular, FIGS. 3 and 4 show the slipcover 30 in accordance with the present invention positioned properly on the sofa 10, whereas FIGS. 5–7 show the slipcover 30 before being applied to the sofa.

In a preferred embodiment, the slipcover 30 is desirably of unitary construction and includes a seat cushion covering portion 32 and a front skirt covering portion 31, a main body covering portion 36 (including a main body portion 46 and arm covering portions 40), and a main body skirt covering portion 48. In a preferred embodiment shown in FIG. 3 in order to minimize the number of parts and seams, the seat cushion covering portion 32 and front skirt covering portion 31 are formed from a single piece of substantially rectangular fabric with a transition line 35 defined therebetween. In an alternative embodiment, the seat cushion covering portion 32 and front skirt covering portion 31 may be formed from two separate pieces of fabric that are sewn together along the transition line 35.

The seat cushion covering portion 32 is delimited by a rear edge, two side edges, and the transition line 35. A cinching element 34 is secured along at least a portion of the rear edge of the seat cushion covering portion 32. In a preferred embodiment, the rear edge of the seat cushion covering portion is substantially linear and has curved or angled corners, wherein a single cinching element 34 extends along the rear edge of seat cushion covering portion, including the curved corners. Alternatively, one or more cinching elements may extend along at least a portion of the rear edge of the seat cushion covering portion 32, excluding the curved or angled corners. In still another embodiment, one or more cinching elements may extend along at least a portion of the rear edge of the seat cushion covering portion 32 and separate cinching elements may be disposed along each of the curved or angled corners.

Thus, cinching element 34 effectively reduces the peripheral dimension of at least a portion of the rear edge of the seat cushion covering portion 32 thereby securing that portion of the seat cushion covering portion around at least a portion of the rear edge of the seat cushions 18*a*, 18*b*. Accordingly, the construction of the slipcover in accordance with the present invention prevents or substantially reduces the seat cushion covering portion from bunching up when someone sits upon the sofa. Since the cinching element is not secured to the transition line 35 between the seat cushion covering portion and the front skirt 34 the crevice 23 formed between the lower front edge of the seat cushion region 18 and the base 12 of the sofa remains concealed beneath the transition line 35 between the seat cushion covering portion 32 and the front skirt covering portion 31. Because the slipcover is not tucked or cinched beneath the lower front edge of the seat cushions into the front crevice 20, the portion of the slipcover covering the front edge of the seat cushion is not bound or cinched but instead is substantially planar thereby providing a draped or "waterfall" appearance.

In a preferred embodiment of the invention, the cinching element 34 is an elastic band which is secured to at least a portion of the periphery of the rear edge of the seat cushion covering portion 32 while the band is in an extended or stretched condition. In this way, when the band is allowed to relax and return to an unstretched condition, it cinches at least a portion of the periphery of the rear edge of the seat cushion covering portion 32 in a manner similar to a shower cap (except that unlike the shower cap, the elastic band provided in the slipcover does not extend around the entire periphery of the seat cushion covering portion). Thus, the seat cushion covering portion 32 is a piece of material with at least a portion of its periphery along a rear edge having a retracted dimension, thereby forming a three-dimensional pouch which in a relaxed unstretched state cinches at least a portion of a rear edge of a seat cushioned region of a piece of seating furniture, while leaving the front edge of the seat cushion uncinched. While the preferred cinching element 34 is an elastic band, alternative cinching elements, such as a drawstring, may be used to effectively reduce at least a portion of the rear edge of the seat cushion covering portion 32, in order to secure the seat cushion covering portion around at least a portion of the rear edge of the seat cushioned region 18 proximate the back 16 of the sofa.

The main body covering portion 36 preferably covers the back 16 of the sofa 10. Where the slipcover 30 is used to cover a sofa 10 having arms 14, the main body portion also desirably covers the arms. Main body covering portion 36 of the slipcover 30 is preferably formed as a relatively long, substantially rectangular piece of material which is folded lengthwise and each end is secured to an arm cinching element 20 while in a stretched state. The arm cinching elements 20 are instrumental in defining the arm covering portions 40 of the slipcover 30, as discussed further herein. The main body portion 36 is preferably inverted subsequent to securing the ends of the main body portion 36 to the arm cinching element 20, so that when the slipcover is positioned on a piece of furniture, any seam allowance (not shown) formed at arm cinching elements 20 is located on the interior surface of the slipcover 30 facing the piece of furniture, thereby providing a neater appearance.

A first lengthwise side 42*a* of the main body portion 36 is secured along the sides and rear edge of the seat cushion covering portion 32 proximate the arms 14 and back 16 of the sofa 10. In a preferred embodiment of the invention, the first lengthwise side 42*a* of the main body portion 36 is joined to the rear edge of the seat cushion covering portion while the cinching element 34 is in its extended position so that upon release of the tension on the cinching element, the effective length of a portion of the first lengthwise side material is effectively reduced due to gathering of the first lengthwise side material by the cinching element.

A second lengthwise side 42*b* of the main body covering portion 36 is preferably unattached to the seat cushion covering portion 32. In a preferred embodiment the second lengthwise side 42*b* of the main body portion 36 is secured to the main body skirt covering portion 48 that extends downward toward the floor to conceal at least a portion of the base 12 of the sofa 10. Since there is no cinching element disposed at the junction between the main body covering portion 36 and the main body skirt covering portion 48, when assembled the slipcover 30 in accordance with the present invention extends relatively smoothly around the back 16 and arms 14 of the sofa 10. In a preferred embodiment, the sides of the front skirt covering portion 31 are secured to the ends of the main body skirt covering portion 38 thereby defining seams 39 proximate the end of each arm covering portion 40 and substantially aligned in a vertical direction with arm cinching elements 20.

In a preferred embodiment of the invention, the substantially rectangular main body covering portion 36 has an increased width at least proximate one of its longitudinal sides, thereby providing a greater amount of material fullness proximate a middle region 46 of the folded main body, i.e., the region opposite that section of the seat cushion covering portion 32 which covers the front side of the seat cushion. Because the main body covering portion 36 is adapted to cover at least the back 16, and preferably the back and arms 14 of a piece of furniture, the greater material fullness proximate the middle region 46 of the main body covering portion 36 enables it to readily cover relatively large, bulky pieces of furniture as well as less bulky pieces of furniture, since any excess slipcover material may be tucked away out of sight when the slipcover is in use, as described in detail herein. Also, if the seat cushion covering portion has a curved contour, darts or pleats (not shown) may be provided in the first longitudinal side 42*a* of the main body covering portion 36 and/or in the rear edge of the seat cushion covering portion 32 so that the fabric lies relatively flat, in a manner conventionally used to provide smooth joining of a relatively straight longitudinal piece of fabric to a curved one.

In a preferred embodiment, pairs of binding elements, such as a cord, a rope, a ribbon, or a strap, are attached to the slipcover proximate the front and back corners of the sofa 10 to provide an aesthetically pleasing appearance as well as to help the slipcover maintain its proper position throughout normal use. By way of example, four pairs of ties, namely, two pairs of front ties 33*a,* 33*d* and two pairs of rear ties, 33*b,* 33*c,* are shown in the Figures as the binding elements, however, any number of pairs of binding elements may be used as desired. In a preferred embodiment, the binding elements are formed from the same fabric or material as the rest of the slipcover. It is, however, within the intended scope of the invention to form the binding elements from material or fabric that is different from that used to form the rest of the slipcover.

Specifically, each pair of binding elements includes a first binding member 33' and a second binding member 33" that are displaced relative to one another. As for the front pairs of binding elements 33*a,* 33*d,* the first binding member is preferably secured on one side of the seam 39 between the second longitudinal side 42*b* of the main body covering portion 36 and the main body skirt covering portion 48, while the second binding member is preferably secured on the opposite side of the seam 39 proximate the transition line 35 between the seat cushion covering portion 32 and the front skirt covering portion 31. In a preferred embodiment, the first and second binding members of each rear binding element pair 33*b,* 33*c* are secured in the seam between the second longitudinal side 42*b* of the main body covering portion 36 and the main body skirt covering portion 48. When the slipcover 30 is positioned over the piece of furniture, the binding elements are preferably in substantially the same plane as the cinching element 34.

As illustrated in FIGS. 3 and 4, when the slipcover 30 is properly positioned on a piece of furniture 10, the seat cushion covering portion 32 is positioned over the seat cushions 18*a,* 18*b,* with the cinching element 34 aligned along at least a portion of the rear edge of the seat cushion region 18. The cinching element 34 effectively reduces at least a portion of the periphery of the rear edge of the seat cushion covering portion 32, thereby drawing at least a portion of the rear edge of the seat cushion covering portion beneath the lower rear edge of the seat cushions 18*a,* 18*b,* and into the rear crevice 24. Because the cinching element 34 cinches at least a portion of the rear edge of the seat cushion covering portion 32 beneath the rear edge of the seat cushions 18*a,* 18*b* of the piece of furniture, the seat cushions are securely and neatly covered by the slipcover 30. Since the cinching element 34 does not extend along the front skirt covering portion 31, the transition between the seat cushion covering portion 32 and the front skirt covering portion 31 is substantially planar and relatively smooth, thereby providing a slipcover appearance.

Figure 10:
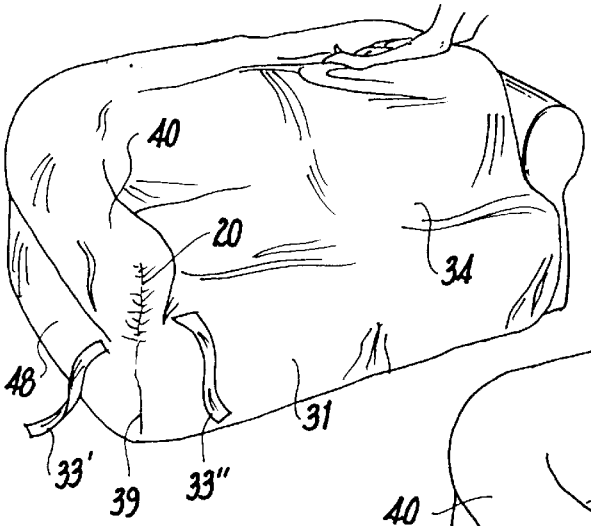
FIG. 10 is a perspective view of a front side of the sofa of FIG. 1 with a slipcover according to the present invention positioned over the seat cushion region thereon and as it appears prior to the tucking in of excess slipcover fabric.

The positioning of the slipcover 30 on a sofa 10 is shown in FIGS. 8–14. Initially the slipcover 30 is draped loosely across the top of the sofa 10 so that the back 16 of the sofa is covered by the main body covering portion 36 of the slipcover, and the seat cushion covering portion 32 covers the seat cushion region 18. Then the main body covering portion 36 is pulled downward over the back 16 of the sofa until the main body skirt covering portion 48 is proximate and substantially parallel to the floor. Beginning from one side of the sofa 10, the slipcover 30 is positioned so that one of the arm covering portions 40 is positioned over an arm 14 of the sofa and the arm cinching element 20 is aligned vertically down the center of the end of that arm. The other arm of the sofa is covered in a similar manner. Once the slipcover 30 is positioned about the arms and back of the sofa, the seat cushions 18*a,* 18*b* are lifted, as shown in FIG. 10, and the cinching element 34 is pulled down and stretched at least along a portion of the rear edge of the seat cushions. In a preferred embodiment, the cinching element 34 extends along the entire rear edge of the seat cushion covering portion, including the curved corners. When the cinching element is released to an unstretched state and the seat cushions are replaced back on the base 12 of the sofa, at least a portion of the rear edge of seat cushion covering portion extends into the crevice 24 between the rear edge of the seat cushions 18*a,* 18*b* and the back 16 of the sofa.

Figure 11:
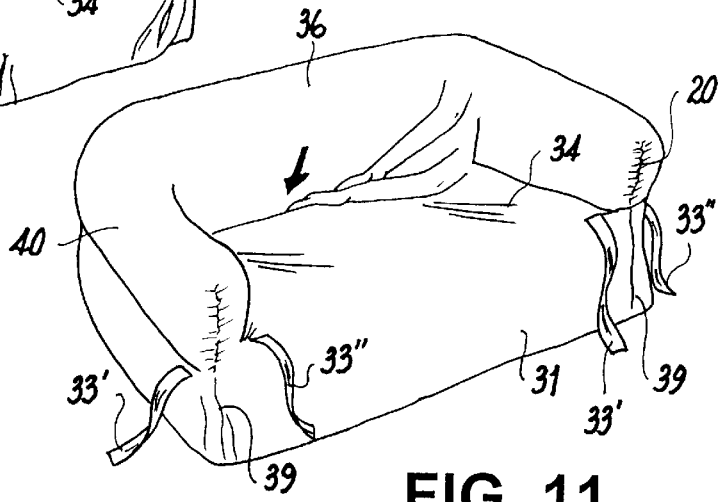
FIG. 11 is a perspective view of a front side of the sofa of FIG. 1 with a slipcover according to the present invention positioned thereon and as it appears after a portion of the excess slipcover fabric is tucked in about the seat cushions.
Figure 12:
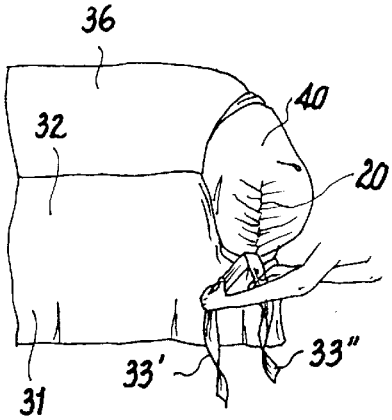
FIG. 12 is a partial perspective view of the sofa of FIG. 1 as it appears with a slipcover according to the present invention positioned thereon as one of the front pairs of binding members is being secured about one of the front corners.
Figure 13:
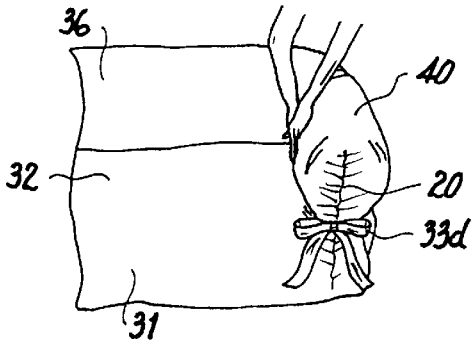
FIG. 13 is a partial perspective view of the sofa of FIG. 1 as it appears with a slipcover according to the present invention being positioned thereon and while excess slipcover material is being pleated proximate the juncture of the arm and the back of the sofa.
Figure 14:
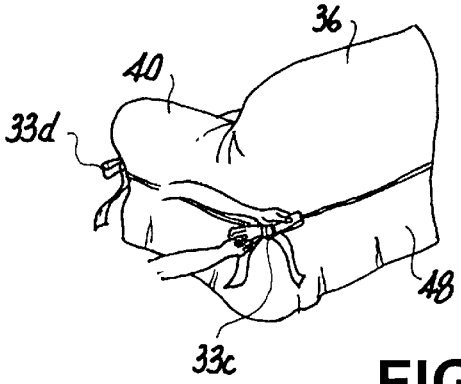
FIG. 14 is a partial perspective view of the sofa of FIG. 1 as it appears with a slipcover according to the present invention positioned thereon as one of the rear pairs of binding members is being secured about one of the rear corners.

In FIG. 11, the seat cushion covering portion 32 is smoothed out around the seat cushions and the front skirt covering portion 31 is aligned so that it is substantially parallel with the floor. Any excess fabric or material of the seat cushion covering portion 32 may be tucked into the crevices 22, 24 between the seat cushions 18*a,* 18*b* and the arms 14 and back 16 of the sofa 10, respectively, until the slipcover is relatively smooth across the seat cushions 18*a,* 18*b.* The front pairs of binding elements 33*a,* 33*d* are tied together in a bow or knot. As shown in FIG. 13, if any excess material remains proximate the juncture of the sofa arms 14 and back 16, it may easily be underlapped to form a series of pleats 52 where the arms and back meet. Lastly the rear pairs of binding elements 33*b,* 33*c* are tied together in a bow or knot.

The slipcover 30 may be made from any of a variety of materials or fabrics, such as typical upholstery-type fabrics or plastic materials. The cinching element 34 may be secured to the seat cushion covering portion 32 and main body portion 46 using any conventional securement methods, such as sewing or adhesive bonding. Where the slipcover 30 is formed from a thermoplastic material, the cinching element 34 may be ultrasonically welded to the slipcover portions, using conventional techniques.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A slipcover for a piece of furniture having a back, arms and at least one seat cushion, said slipcover comprising:

a pouch-shaped seat cushion covering portion having a rear edge and a front edge;

an adjusting member secured to at least a portion of the rear edge of said seat cushion covering portion for varying at least a portion of a peripheral dimension of the rear edge thereof while at least a portion of the front edge of said seat cushion covering portion remains uncinched; and a pouch-shaped main body covering portion for covering the back and arms of the piece of furniture, said main body covering portion having a first longitudinal side and a second longitudinal side, the rear edge of said seat cushion covering portion being secured to the first longitudinal side of said main body covering portion.

2. The slipcover in accordance with claim 1, wherein said adjusting member comprises an elastic band secured to at least a portion of a periphery of the rear edge of said seat cushion covering portion.

3. The slipcover in accordance with claim 2, wherein said elastic band is secured while in a stretched state such that a peripheral dimension of at least a portion of the rear edge of said seat cushion covering portion is effectively reduced when the elastic band assumes a relaxed state.

4. The slipcover in accordance with claim 1, further comprising a front skirt covering portion integral with said seat cushion covering portion, a transition area defined at an interface between said seat cushion covering portion and said front skirt covering portion being uncinched to provide a draped slipcover appearance.

5. The slipcover in accordance with claim 1, further comprising a front skirt covering portion secured to said seat cushion covering portion.

6. The slipcover in accordance with claim 5, further comprising a main body skirt covering portion secured to the second longitudinal side of said main body covering portion between the first and second ends thereof.

7. The slipcover in accordance with claim 1, wherein said main body covering portion terminates in a first end and a second end, each end of said main body covering portion is secured to form closed ends defining arm portions for conforming to the arms of the piece of furniture.

8. The slipcover in accordance with claim 7, further comprising an arm cinching element attached to at least a portion of the closed ends of said main body covering portion.

9. The slipcover in accordance with claim 1, further comprising a pair of binding elements disposed proximate one of a front corner and a rear corner of the piece of furniture for securing the slipcover on the piece of furniture.

10. The slipcover in accordance with claim 9, wherein said pair of binding elements comprises a first binding member and a second binding member.

11. The slipcover in accordance with claim 10, where the first and second binding members comprise one of a cord, rope, ribbon, and strap.

12. The slipcover in accordance with claim 11, wherein the first and second binding members are one of tied and knotted.

13. The slipcover in accordance with claim 9, wherein said pair of binding elements, when secured about the piece of furniture, extend in substantially the same plane as said cinching element to further secure the slipcover to the piece of furniture.

14. A combination comprising:

a piece of furniture including a base, a back, first and second arms, and at least one seat cushion having a rear edge; and a unitary slipcover positioned on said piece of furniture and covering at least the back, arms, and the seat cushion, said slipcover including a seat cushion covering portion having a rear edge and a front edge, and a cinching element secured to at least a portion of the rear edge of said seat cushion covering portion, said cinching element securing the slipcover about at least a portion of the rear edge of the seat cushion of said piece of furniture, so that at least a portion of the slipcover extends beneath at least a portion of the rear edge of the seat cushion proximate the back of said piece of furniture while at least a portion of the front edge of said seat cushion covering portion remains uncinched.

15. The combination in accordance with claim 14, wherein the seat cushion and the back of said piece of furniture define a rear crevice therebetween, and wherein at least a portion of said slipcover extends into the rear crevice proximate at least a portion of the rear edge of the seat cushion.

16. The combination in accordance with claim 14, wherein a lower front edge of the seat cushion and the base of said piece of furniture define a front crevice therebetween, and wherein the slipcover extends over the front crevice to provide a draped slipcover appearance.

17. A one-piece slipcover for covering a piece of furniture having a back, arms and at least one seat cushion having a rear edge, said slipcover comprising:

a first pouch for covering the back and arms of the piece of furniture;

a second pouch secured to said first pouch for covering the seat cushion of the piece of furniture, said second pouch having a rear edge and a front edge;

a cinching element secured to at least a portion of the rear edge of said second pouch, said cinching element securing a portion of the slipcover beneath at least a portion of the rear edge of the seat cushion of the piece of furniture while at least a portion of the front edge of said second pouch remains uncinched.

18. A one-piece slipcover for covering a piece of furniture having a base, back, arms and at least one seat cushion positioned on the base, said slipcover comprising:

a main body portion for covering the back of the piece of furniture and terminating at first and second ends in shaped arm covering portions for covering the arms of the piece of furniture;

a seat cushion covering portion secured to said main body portion, said seat cushion covering portion having a rear edge and a front edge; and a cinching element secured to at least a portion of the rear edge of said seat cushion covering portion, said cinching element biasing at least a portion of the slipcover beneath at least a portion of the rear edge of said seat cushion covering portion while at least a portion of the front edge of said seat cushion covering portion remains uncinched.

19. The one-piece slipcover in accordance with claim 18, further comprising at least one pair of binding members secured about at least one of front and rear corners of the piece of furniture.

20. The one-piece slipcover in accordance with claim 19, wherein each pair of binding members includes a first binding member and a second binding member.

21. The one-piece slipcover in accordance with claim 20, wherein the first and second binding members comprise one of a cord, rope, ribbon, and strap.

22. The one-piece slipcover in accordance with claim 21, wherein the first and second binding members are one of tied and knotted.

23. The one-piece slipcover in accordance with claim 19, wherein said pair of binding elements, when secured about the piece of furniture, extend in substantially the same plane as said cinching element to further secure the slipcover to the piece of furniture.

24. The one-piece slipcover in accordance with claim 18, further comprising a skirt having an uncinched front skirt portion integral to said seat cushion covering portion for covering a portion of the base of the piece of furniture extending from said seat cushion covering portion toward a lower surface of the piece of furniture to provide a slipcover appearance.

25. The one-piece slipcover in accordance with claim 24, wherein said skirt further comprises a main body skirt portion secured to said main body covering portion and extending between the first and second terminating ends thereof.

26. The one-piece slipcover in accordance with claim 18, further comprising a skirt having an uncinched front skirt portion secured to said seat cushion covering portion for covering a portion of the base of the piece of furniture extending from said seat cushion covering portion toward a lower surface of the piece of furniture to provide a slipcover appearance.

27. The one-piece slipcover in accordance with claim 26, wherein said skirt further comprises a main body skirt portion secured to said main body covering portion and extending between the first and second terminating ends thereof.

28. The one-piece slipcover in accordance with claim 18, wherein said cinching element is an elastic band.

29. A one-piece slipcover adapted to cover the back, arms, and seat cushion of a piece of furniture, said slipcover including a main body covering portion for covering the back and arms of the piece of furniture, comprising:

a seat cushion covering portion for covering the seat cushion of the piece of furniture, said seat cushion covering portion having a rear edge and a front edge; and means for biasing at least a portion of the slipcover substantially directly beneath a portion of a rear edge of the seat cushion, said biasing means comprising a cinching element terminating in first and second ends, said cinching element being secured between the first and second ends to at least a portion of the rear edge of said seat cushion covering portion while at least a portion of the front edge of said seat cushion covering portion remains uncinched.

30. A one-piece slipcover for a piece of furniture having a base, a back, a pair of arms, and a seat cushion, said slipcover comprising:

a main body covering portion for covering the back and the pair of arms of the piece of furniture;

a seat cushion covering portion for covering the seat cushion of the sofa, said seat cushion covering portion having a rear edge and a front edge; and a cinching element secured to at least a portion of the rear edge of said seat cushion covering portion, and said cinching element being adapted to gather a portion of the slipcover beneath at least a portion of a lower rear edge of the seat cushion while at least a portion of the front edge of said seat cushion covering portion remains uncinched.

31. The one-piece slipcover in accordance with claim 30, further comprising an uncinched main body skirt covering portion secured to a periphery of said main body covering portion, said main body skirt covering portion extending downward from said main body covering portion to cover at least a portion of the base proximate the arms and back of the piece of furniture.

32. The one-piece slipcover in accordance with claim 30, further comprising a front skirt covering portion secured to said seat cushion covering portion for covering a portion of the base of the piece of furniture extending from said seat cushion covering portion toward a lower surface of the piece of furniture to thereby provide a slipcover appearance.

33. A combination comprising:

a piece of furniture including a back, a pair of arms, a base, and at least one seat cushion positioned on the base; and a slipcover comprising:

a seat cushion covering pouch covering the seat cushion, said seat cushion covering pouch having a rear edge and a front edge;

a cinching element secured to at least a portion of the rear edge of said seat cushion covering pouch while at least a portion of the front edge of said seat cushion covering pouch remains uncinched;

a main body covering pouch secured to a portion of said seat cushion covering pouch and covering the back and arms of the piece of furniture; and a skirt secured to said main body covering pouch, extending around the back of the piece of furniture, and terminating at the end of each arm.

34. The combination in accordance with claim 33, wherein said cinching element is an elastic band.

35. The combination in accordance with claim 34, wherein said cinching element is secured to at least a portion of the rear edge of said seat cushion covering pouch while in a stretched state such that at least a portion of a peripheral dimension of the rear edge of said seat cushion covering pouch is effectively reduced when the elastic band assumes a relaxed state.

36. The combination in accordance with claim 33, wherein the seat cushion and the back of the piece of furniture define a rear crevice therebetween, and at least a portion of the slipcover extends into the rear crevice.

37. The combination in accordance with claim 33, wherein a front edge of the seat cushion and the base of the piece of furniture define a front crevice therebetween, and wherein the slipcover extends over the front crevice to provide a draped slipcover appearance.

38. The combination in accordance with claim 33, further comprising at least one pair of binding members secured about at least one corner of the piece of furniture.

39. The combination in accordance with claim 33, further comprising a pair of binding members secured about each corner of the piece of furniture.

40. A slipcover for covering a piece of furniture having a base, arms, a back, and at least one seat cushion with a rear edge, comprising:

a seat cushion covering pouch for enveloping at least a portion of the rear edge of the seat cushion of the piece of furniture, said seat cushion covering pouch having a rear edge and a front edge;

a front skirt covering portion integral to said seat cushion covering portion, said front skirt covering portion being uncinched to provide a slipcover appearance;

a cinching element secured to at least a portion of the rear edge of said seat cushion covering pouch for tightening at least a portion of the rear edge of said seat cushion covering pouch about at least a portion of the rear edge of the seat cushion while at least a portion of the front edge of said seat cushion covering pouch remains uncinched; and a substantially rectangular main body portion having a first longitudinal edge and a second longitudinal edge, said main body portion being folded longitudinally and secured together at its respective ends to define first and second arm covering portions, the first longitudinal edge being secured along a portion of the periphery of said seat cushion covering portion, and the second longitudinal edge being substantially free to define an open pouch with said arm covering portions and the first longitudinal edge for receiving a back and a pair of arms of the piece of furniture.

41. The slipcover in accordance with claim 40, further comprising at least one pair of binding elements, when secured about the piece of furniture, said pair of binding elements extend in substantially the same plane as said cinching element to further secure the slipcover to the piece of furniture.

42. The slipcover in accordance with claim 40, further comprising a main body skirt covering portion secured to the second longitudinal edge of said main body covering portion and covering at least a portion of the base of the piece of furniture.

43. A one-piece slipcover for covering a piece of furniture having a back, arms, a base and at least one seat cushion, said slipcover comprising:

a main body portion for covering at least the back and arms of the piece of furniture;

a seat cushion covering portion for covering the seat cushion of the piece of furniture, said seat cushion having a front edge and a substantially linear rear edge terminating in curved corners; and a first cinching element secured to at least a portion of the substantially linear rear edge of said seat cushion covering portion while at least a portion of the front edge of said seat cushion covering portion remains uncinched.

44. The one-piece slipcover in accordance with claim 43, wherein said first cinching element is secured along the substantially linear rear edge of said seat cushion covering portion.

45. The one-piece slipcover in accordance with claim 43, wherein said first cinching element is secured along the curved corners and the substantially linear rear edge of said seat cushion covering portion.

46. The one-piece slipcover in accordance with claim 43, further comprising a second cinching element secured to at least a portion of one of the curved corners of the seat cushion covering portion.

47. The one-piece slipcover in accordance with claim 46, further comprising a third cinching element secured to at least a portion of one of the curved corners of the seat cushion covering portion.

* * * * *